US010706649B2

(12) United States Patent
Kuenzi et al.

(10) Patent No.: US 10,706,649 B2
(45) Date of Patent: Jul. 7, 2020

(54) DUAL CARD PROGRAMMING FOR ACCESS CONTROL SYSTEM

(71) Applicant: CARRIER CORPORATION, Palm Beach Gardens, FL (US)

(72) Inventors: Adam Kuenzi, Silverton, OR (US); Troy Klopfenstein, Salem, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/074,914

(22) PCT Filed: Jan. 11, 2017

(86) PCT No.: PCT/US2017/012934

§ 371 (c)(1),
(2) Date: Aug. 2, 2018

(87) PCT Pub. No.: WO2017/136111

PCT Pub. Date: Aug. 10, 2017

(65) Prior Publication Data

US 2019/0035188 A1 Jan. 31, 2019

Related U.S. Application Data

(60) Provisional application No. 62/291,042, filed on Feb. 4, 2016.

(51) Int. Cl.

| | |
|---|---|
| ***G07C 9/00*** | (2020.01) |
| ***G07C 9/20*** | (2020.01) |
| ***G07C 9/29*** | (2020.01) |

(52) U.S. Cl.
CPC ..... *G07C 9/00182* (2013.01); *G07C 9/00904* (2013.01); *G07C 9/20* (2020.01);
(Continued)

(58) Field of Classification Search
CPC ..... G07C 9/00182; B60R 25/24
See application file for complete search history.

(56) References Cited

U.S. PATENT DOCUMENTS 5,508,691 A 4/1996 Castleman et al.
5,979,773 A * 11/1999 Findley, Jr. ..... G06Q 20/206 235/380

(Continued)

FOREIGN PATENT DOCUMENTS

CN 101950367 A 1/2011
CN 201754275 U 3/2011

(Continued)

OTHER PUBLICATIONS

International Search Report for PCT/US20171012934 dated Mar. 30, 2017.

*Primary Examiner* — Fabricio R Murillo Garcia
(74) *Attorney, Agent, or Firm* — Bachman & LaPointe, P.C.

(57) ABSTRACT

A method of programming an access control system including presenting an access card and a configuration card to a device; determining a validity of the access card at the device; process the configuration card at the device; decrypting a payload on the configuration card based on information from the access card; using the payload form the configuration card to switch the device to a high security mode of operation.

22 Claims, 7 Drawing Sheets

(52) U.S. Cl.
CPC ..... *G07C 9/29* (2020.01); *G07C 2009/0023* (2013.01); *G07C 2009/00412* (2013.01); *G07C 2009/00793* (2013.01); *G07C 2009/00825* (2013.01); *G07C 2009/00841* (2013.01); *G07C 2209/14* (2013.01)

(56) References Cited

U.S. PATENT DOCUMENTS

| | | | | |
|---|---|---|---|---|
| 6,677,852 | B1 | 1/2004 | Landt | |
| 6,995,655 | B2 | 2/2006 | Ertin et al. | |
| 7,360,091 | B2 | 4/2008 | Aikawa et al. | |
| 7,475,806 | B1 | 1/2009 | Crossno et al. | |
| 8,044,773 | B2 | 10/2011 | Posamentier | |
| 8,245,219 | B2 | 8/2012 | Agarwal et al. | |
| 8,905,309 | B2 | 12/2014 | Leutgeb et al. | |
| 9,016,561 | B2 | 4/2015 | Corda et al. | |
| 9,104,899 | B2 | 8/2015 | Leutgeb et al. | |
| 9,128,829 | B2 | 9/2015 | Corda et al. | |
| 2004/0263316 | A1* | 12/2004 | Dix | B60R 25/04 340/5.23 |
| 2007/0215698 | A1* | 9/2007 | Perry | G06Q 20/20 235/380 |
| 2010/0058309 | A1 | 3/2010 | Lu et al. | |
| 2013/0241701 | A1 | 9/2013 | Almond et al. | |
| 2014/0320261 | A1 | 10/2014 | Davis et al. | |
| 2015/0356799 | A1* | 12/2015 | Blochle | G06K 7/10366 235/382 |

FOREIGN PATENT DOCUMENTS

| | | | |
|---|---|---|---|
| CN | 102479089 | A | 5/2012 |
| CN | 202495102 | U | 10/2012 |
| CN | 204440431 | U | 7/2015 |
| EP | 2704106 | A1 | 3/2014 |
| WO | 98/52136 | A1 | 11/1998 |
| WO | 2011120315 | A1 | 10/2011 |

* cited by examiner

DUAL CARD PROGRAMMING FOR ACCESS CONTROL SYSTEM

BACKGROUND

The present disclosure relates generally to access control systems, and more particularly, to a system and a method of programming an access control.

An access control system is typically operated by encoding data on a physical key card that indicates access rights. Some access control systems are online where the access control reader that reads key cards can use some means to communicate with the access control system. In online systems the access rights are usually a reference identifier. An example is a building entry system where an employee uses a RFID badge to access a door that has a reader with means to convey the badge id into a networked access control system that has means to permit or deny access based on access rights associated to the reference identifier and additionally based upon the time and date allowed for access. In this example, the reader does not have means to determine the time and date, but the access control system does. Other access control systems are offline and the access rights are encoded as data that can be decoded and interpreted by the offline access control lock to retrieve the access rights. An example is a hotel locking system where a front desk encodes a guest card and an offline, battery powered lock on a guest room door has the means to decode the key card and permit or deny access based on the encoded access rights and based on the time and date allowed for access. In this example, the door lock has means to determine time and date. Some methods of encoding access rights include sequencing where subsequent access rights have a sequence number that is greater than the prior access rights. Some other methods of encoding access rights include an expiration window where the access rights will not provide access before a certain date and time or after another certain date and time.

Conventional access control systems utilize encryption, i.e., AES, RSA, ECC, etc., to perform cryptographic operations to authenticate communications with physical cards or virtual cards passed over Near Field Communications (NFC) or Bluetooth. Additionally, encryption is also used to encode data on the key card where the access rights may be encoded as encrypted data or as a digital certificate which may also be encrypted. Sometimes the keys used for authenticating cards are different than the encryption keys used to encode data on the cards. Locks and readers and encoders require these various encryption keys to be programmed before entry into service or are occasionally changed as part of normal encryption key management. Management of these encryption keys requires a programming device and programming operation to program the encryption keys that are specific to the access control system being put into service. A conventional method of setting keys in a reader or lock is to use a programming device. Another conventional method is to use a single configuration card that has the new keys on the card rather than access rights. The card can be read by an online reader, but since the reader does not have a real time clock, it cannot expire the configuration card even if an expiration window is encoded on the card. In some cases, a reader that is part of a lock may not be able to expire the configuration card either as the reader is a module that doesn't have means to get the time and date from the lock. Because the configuration card may not expire, it needs to be carefully controlled. Another conventional cryptographic operation, is to preload the specific encryption keys in the factory and pre-configure the lock for the property before being put into service, however this creates an operational process that can be cumbersome for a factory to manage.

High security RFID systems are available to replace older, less secure technologies. For example, MIFARE Plus uses high security AES 128-bit encryption keys and is an upgrade from MIFARE Classic which uses 48-bit keys for a proprietary encryption algorithm. However locks and readers can be made that support both MIFARE Plus and MIFARE Classic. In some cases there is a need to switch the reader into a high security only mode and optionally to set the high security encryption keys.

It would be advantageous to be able to operate high-security locks with legacy software systems to minimize the operational impact of upgrading the entire system all at once. Additionally, it would be advantageous to have a secure process for upgrading or rolling keys that uses a card and is not dependent on a programmer or special device or required to be pre-configured in a factory. Additionally, it would be advantageous to have a configuration card that expires for all types of devices.

SUMMARY

A method of programming an access control system, the method according to one disclosed non-limiting embodiment of the present disclosure can include presenting an access card and a configuration card to a device; determining a validity of the access card at the device; processing the configuration card at the device in response to the validity of the access card; decrypting a payload on the configuration card based on information from the access card; and using the payload from the configuration card to switch the device to a high security mode of operation.

A further embodiment of the present disclosure may include, wherein switching to a high security mode of operation could be to change any programmable parameter in the access control device.

A further embodiment of the present disclosure may include, using encryption keys from the payload on the configuration card for use with a device that is a door lock.

A further embodiment of the present disclosure may include, using encryption keys from the payload on the configuration card for use with a device that is an encoder.

A further embodiment of the present disclosure may include, wherein presenting the access card and the configuration card includes presenting the access card and the configuration card as high security cards.

A further embodiment of the present disclosure may include, wherein presenting the access card and the configuration card includes presenting the access card as a low security card and the configuration card as high security card.

A further embodiment of the present disclosure may include, wherein presenting the access card and the configuration card includes presenting at least one of the access card and the configuration card via a mobile device.

A further embodiment of the present disclosure may include, wherein presenting the access card and the configuration card includes presenting the access card and the configuration card via a mobile device.

A further embodiment of the present disclosure may include, wherein switching the device to a high security mode of operation is a software based front desk system that is upgrading an old system and keys are being transferred from the old system to a new software system.

A further embodiment of the present disclosure may include, wherein processing the configuration card at the device in response to the validity of the access card is not processing the configuration card if the access card is expired.

A method of programming an access control system, the method according to one disclosed non-limiting embodiment of the present disclosure can include encoding a first card as an access card and a second card as a configuration card; presenting the access card and the configuration card to a device; determining a validity of the access card at the device; processing the configuration card at the device in response to the validity of the access card; decrypting a payload on the configuration card based on information from the access card; and using the payload form the configuration card to switch the device to a high security mode of operation.

A further embodiment of the present disclosure may include, wherein information from the access card is used to create a diversified encryption key by an encryption process that incorporates multiple information inputs and produces an encryption key that is related to all of the inputs which is then used to encrypt the contents of the configuration card.

A further embodiment of the present disclosure may include, using encryption keys from the payload on the configuration card for use with an access control device.

A further embodiment of the present disclosure may include, using encryption keys from the payload on the configuration card for use with a device that is a door lock.

A further embodiment of the present disclosure may include, using encryption keys from the payload on the configuration card for use with a device that is an encoder.

A further embodiment of the present disclosure may include, wherein presenting the access card and the configuration card includes presenting the access card and the configuration card as high security cards.

A further embodiment of the present disclosure may include, wherein presenting the access card and the configuration card includes presenting the access card as a low security card and the configuration card as high security card.

A further embodiment of the present disclosure may include, wherein presenting the access card and the configuration card includes presenting at least one of the access card and the configuration card via a mobile device.

A further embodiment of the present disclosure may include, wherein presenting the access card and the configuration card includes presenting the access card and the configuration card via a mobile device.

A further embodiment of the present disclosure may include, providing an indication of completion in response to the switch of the device to the high security mode of operation.

A further embodiment of the present disclosure may include, presenting the access card and the configuration card simultaneously.

A further embodiment of the present disclosure may include, wherein processing the configuration card at the device in response to the validity of the access card is not processing the configuration card if the access card is expired.

A system for programming an access control according to one disclosed non-limiting embodiment of the present disclosure can include an encoder to encode an access card and a configuration card that program the access control when presented together to the access control.

A further embodiment of the present disclosure may include, wherein the access card and the configuration card are presented simultaneously.

A further embodiment of the present disclosure may include, wherein the access card and the configuration card are presented in sequence.

A further embodiment of the present disclosure may include, wherein the configuration card is not processed if the access card is expired.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
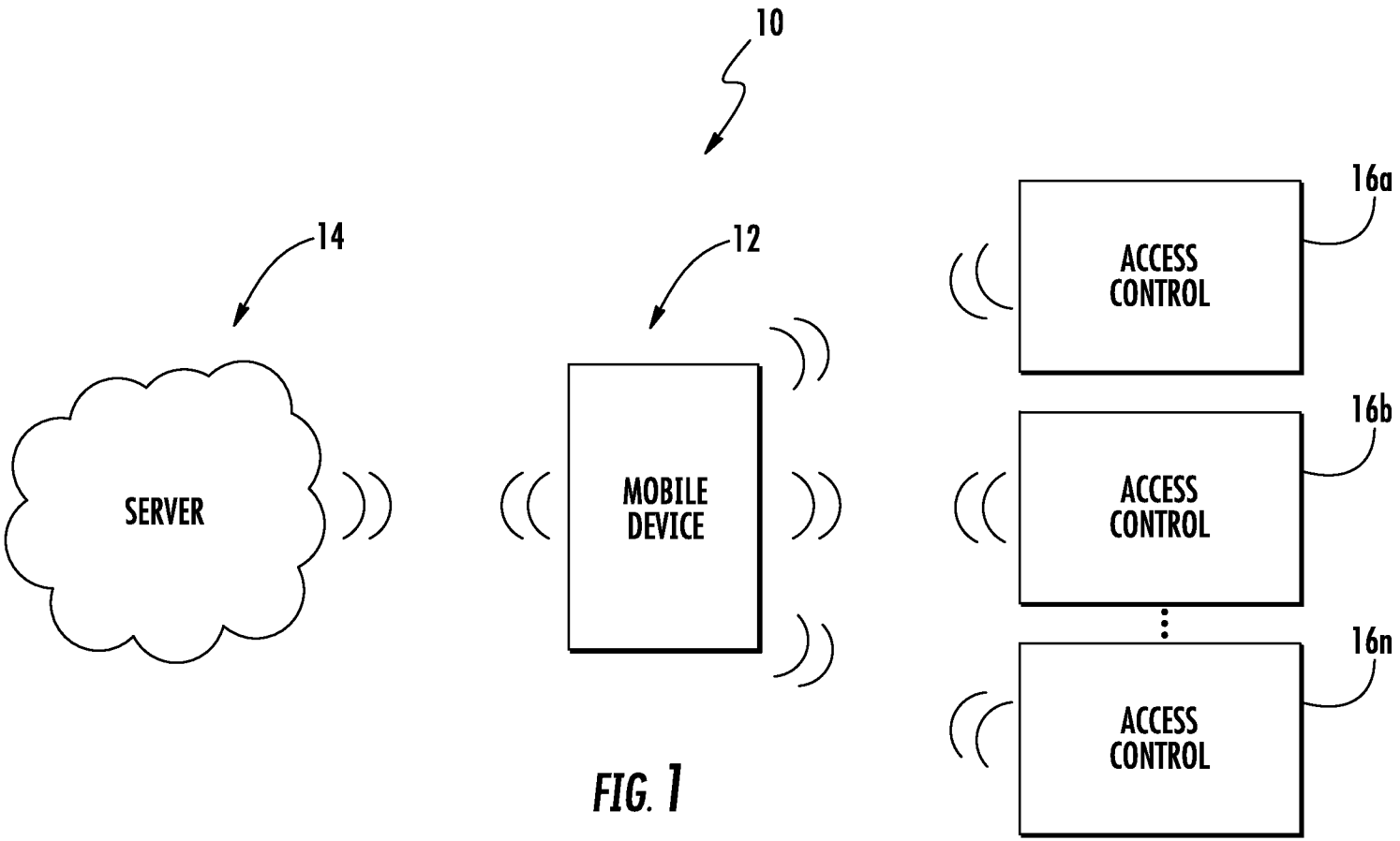
FIG. 1 is a general schematic system diagram of an access control system.

FIG. 1 schematically illustrates an access control system 10. The system 10 generally includes a mobile device 12, a server 14, and a plurality of access controls 16, schematically illustrated as 16*a*, 16*b*, . . . , 16*n* along with a front desk interface 28 which communicates with an encoder 300 to encode guest cards 204 and/or communicates with a programmer 21 to program the access controls 16*a*, 16*b*, . . . , 16*n*. In one embodiment, the front desk interface 28 is integrated with the programmer 21 to provide for an integrated platform. In another embodiment, the front desk interface 28 is integrated with the encoder 300 to provide for a portable check-in experience where an administrator can roam in a lobby area checking guests into rooms. It should be appreciated that, although particular systems are separately defined in the schematic block diagrams, each or any of the systems may be otherwise combined or separated via hardware and/or software.

The mobile device 12 may be a wireless capable handheld device such as a smart phone that is operable to communicate with the server 14 and the access controls 16. The server 14 may provide credentials and other data to the mobile device 12, such as firmware or software updates to be communicated to one or more of the access controls 16. Although the server 14 is depicted herein as a single device, it should be appreciated that the server 14 may alternatively be embodied as a multiplicity of systems, from which the mobile device 12 receives credentials and other data.

Each access control 16 is a wireless-capable, restricted-access, or restricted-use device such as wireless access control 16, access control readers for building entry, electronic banking controls, data transfer devices, key dispenser devices, tool dispensing devices, and other restricted-use machines. The mobile device 12 submits credentials to the access controls 16, thereby selectively permitting a user to access or activate functions of the access controls 16. A user may, for example, submit a credential to an electromechanical lock to unlock it, and thereby gain access to a restricted area. In another example, a user may submit a credential to an electronic banking control to withdraw funds. In still another example, the user may submit the credential to a unit that dispenses key cards with data associated with or data retrieved from the credential. A mobile device 12 may store credentials for one or all or other of the examples noted above, and in addition may store a plurality of credentials for each type of application at the same time. Some credentials may be used for multiple access controls 16. For example, a plurality of electronic access control 16 in a facility may respond to the same credential. Other credentials may be specific to a single access control 16.

Figure 2:
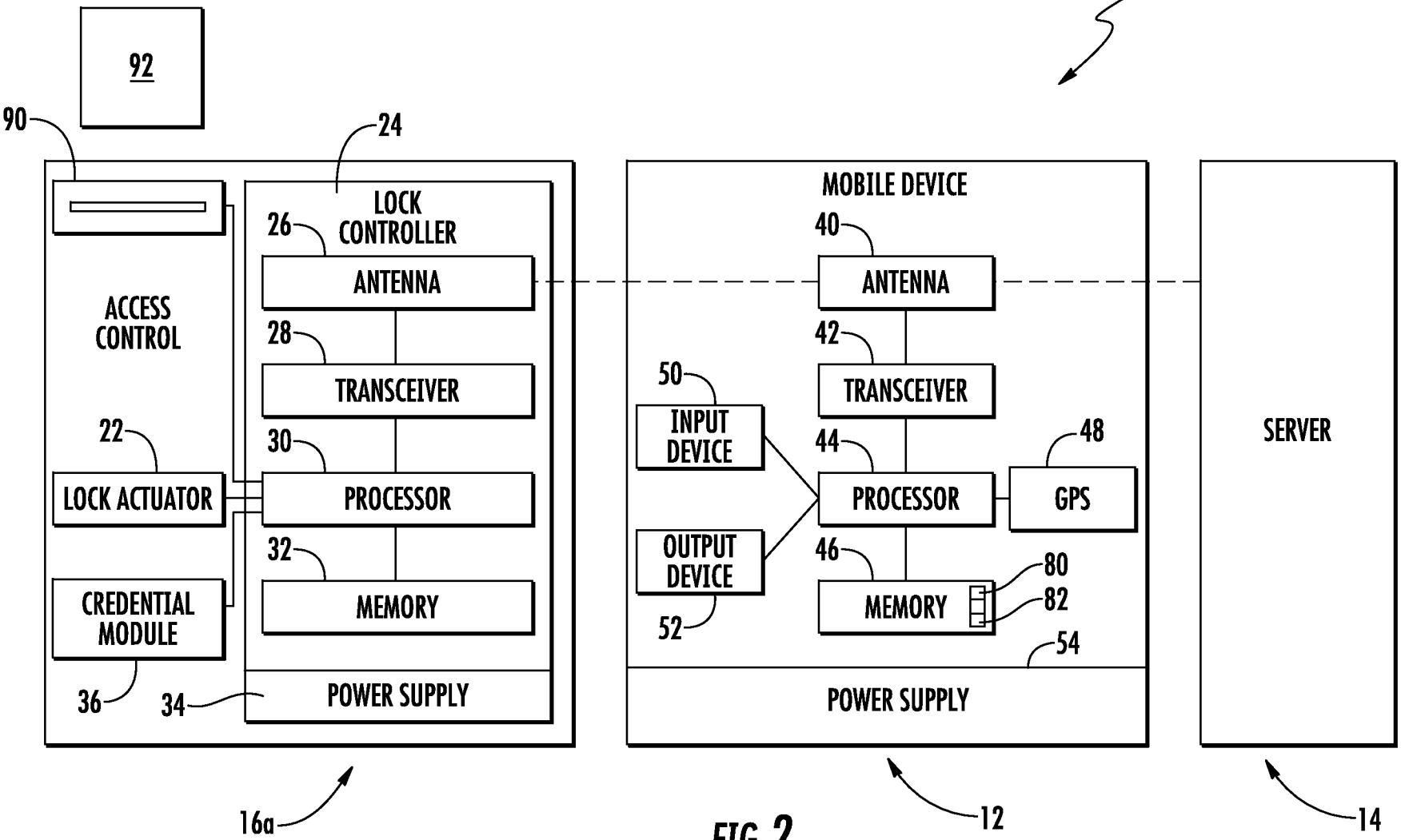
FIG. 2 is a block diagram of access control.

With reference to FIG. 2, a block diagram of an access control 16*a* generally includes a lock actuator 22, a lock controller 24, a lock antenna 26, a lock transceiver 28, a lock processor 30, a lock memory 32, a lock power supply 34, a lock card reader 90 and a credential module 36. The lock card reader 90 may include a card reading subsystem 91, a communication subsystem 93, to communicate with the lock processor 30, a feedback subsystem 95 such as a light, buzzer, etc. The lock card reader 90 reads physical cards and then sends the data to the lock processor 30 for decoding and determining if the access device 16 may be accessed. Alternatively, the reader 90 could be included in an embodiment as a lock for a door 16*a*, or in a reader 16*b* on a building where the door is controlled by a door controller component separate from the access control 16*b* with the reader 90 and where the communication subsystem 93 is used by the reader 16*b* to communicate with the networked access control system. Alternatively, the reader 90 or lock processor 30 could have means to determine date and time.

The access control 16*a* is responsive to credentials from a physical card and/or the mobile device 12. Upon receiving and authenticating an appropriate credential from the mobile device 12 using the credential module 36, or after receiving card data from lock card reader 90, the lock controller 24 commands the lock actuator 22 to lock or unlock a mechanical or electronic lock. The lock controller 24 and the lock actuator 22 may be parts of a single electronic or electromechanical lock unit, or may be components sold or installed separately.

The lock transceiver 28 is capable of transmitting and receiving data to and from at least the mobile device 12. The lock transceiver 28 may, for instance, be a near field communication (NFC), Bluetooth, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate card data and determine the access rights contained in the card data or to pass messages from a transceiver to a credential module 36 and to receive a response indication back from the credential module 36 with card data. The lock memory 32 may be RAM, EEPROM, or other storage medium where the lock processor 30 can read and write data including but not limited to lock configuration options and the lock audit trail. The lock audit trail may be a unified audit trail that includes events initiated by accessing the lock via the lock card reader 90 or the mobile device 12. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt).

The credential module 36 is in communication with the lock processor 30 and is operable to decrypt and validate a credential to extract virtual card data communicated into the lock controller 24 as a "virtual card read." That is, the access control 16*a* has essentially two readers, one reader 90 to read a physical key card and the credential module 36 to communicate with the mobile device 12 via the lock processor 30 and the transceiver 28 and antenna 26.

While the FIG. 2 shows the lock antenna 26 and the transceiver 28 connected to the processor 30, this is not to limit other embodiments that may have additional antenna 26 and transceiver 28 connected to the credential module 36 directly. The credential module 36 may contain a transceiver 28 and antenna 26 as part of the credential module. Or the credential module 36 may have a transceiver 28 and antenna 26 separately from the processor 30 which also has a separate transceiver 28 and antenna 26 of the same type or different. In some embodiments, the processor 30 may route communication received via transceiver 28 to the credential module 36. In other embodiments the credential module may communicate directly to the mobile device 12 through the transceiver 28.

Figure 3:
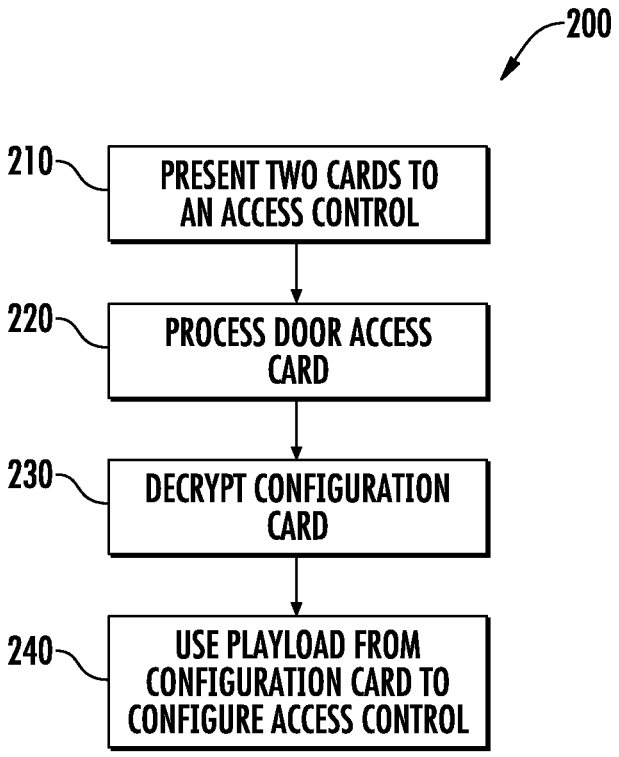
FIG. 3 is a flowchart for programming an access control system.
Figure 4:
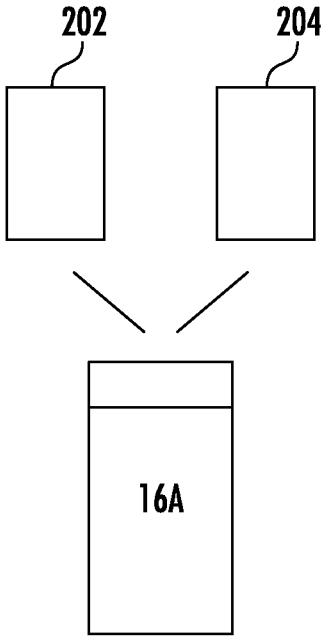
FIG. 4 is a schematic view of the access control configuration.
Figure 7:
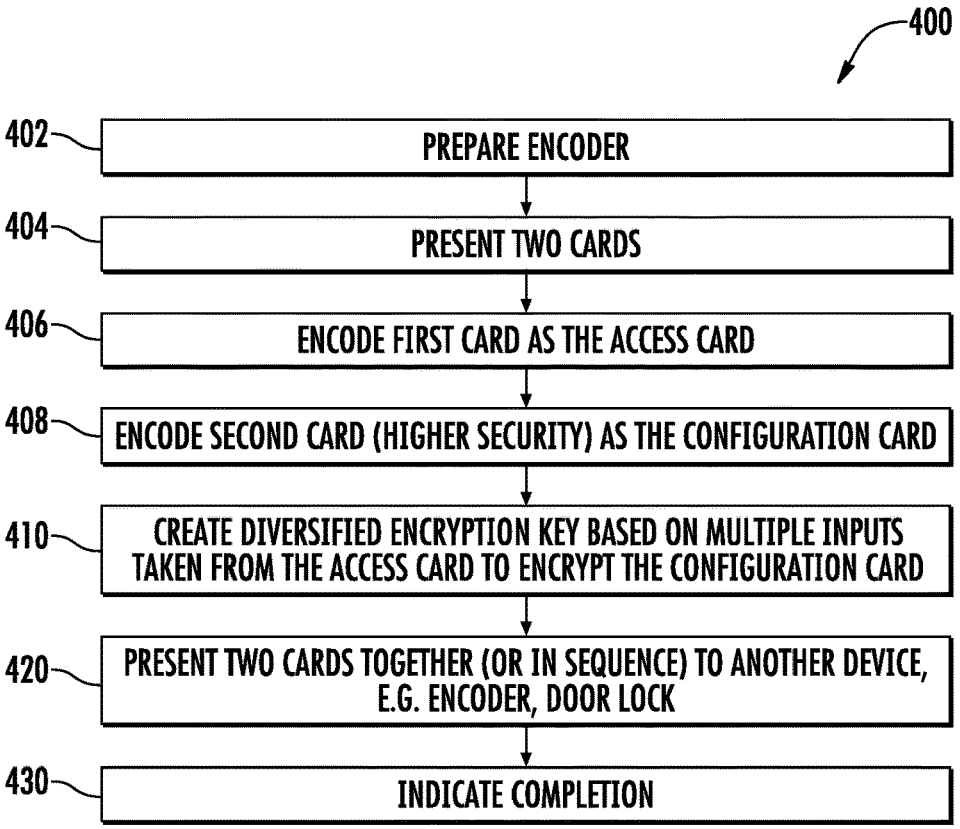
FIG. 7 is a flowchart for a dual card encoding method.

With reference to FIG. 3, a method 200 of programming encryption keys and possibly other configuration data into high-security card readers is generally illustrated in a simplified block diagram format. The method follows the method of changing the encoder behavior when encoding an access card when two cards are detected in the RFID field (FIG. 7). One card is an access card 204 such as a Hotel Master card, guest card, or other, such card while the other card is a configuration card 202 (FIG. 4). The difference between the two cards is the semantics of the payload on the card and how the payload is encrypted on the card.

After encoding, with reference again to FIG. 3, when presenting the two cards simultaneously to an access control 16 (step 210), the access control 16 detects the two cards and will process the door access card 204 first (step 220). On success it then decrypts the configuration card 202 (step 230) and then uses the configuration card 202 payload to configure the access control 16 (step 240), for example, to roll to new keys, to change operating modes, or set any other configurable parameter that is typically set in the access control 16. In an embodiment where the access control 16 is a wall reader in an online access control system, processing the door access card 204 (again, step 220) would include first reading the access rights from the card (encoded as a reference identifier), passing the access rights to the networked access control system, and receiving back at the access control 16 an indication that the access control system accepted the card. The indication from the access control system could be a message, or a signal line that indicates the reader 16 should give positive feedback (i.e. Green LED or positive beep tones, etc.) or negative feedback (i.e. Red LED or negative beep tones, etc.). Further, in this embodiment, the step 230 would then only proceed if the positive indicator was given. An alternate embodiment is where the access control 16 is a hotel door lock with components as shown in FIG. 2 as part of an offline access control system. In this embodiment, processing the door access card 204 (step 220) could be the same as the previous embodiment where the reader 90 is like the wall reader with means to pass the encoded access rights data to the processor 30 which gives an indication back to the reader of success. A successful indication would mean that the access rights were accepted and not expired. Again, in this embodiment, the step 230 would then only proceed where the reader 90 then decrypts the configuration card payload and in step 240 the reader 90 processes the card payload if the access rights were accepted and not expired. In this embodiment the reader 90 securely stores the encryption keys for reading cards and the keys are not exposed to the lock processor 30. Yet another embodiment is where the reader 90 passes all data and steps 230 and 240 are done by the lock processor 30 and in this embodiment the lock processor securely stores the encryption keys and configures the reader 90 with the keys so the reader can read cards. Yet another embodiment is where the reader 90 and lock processor 30 are combined. Yet another embodiment is where the reader 90 gets the date and time from the lock processor 30 so that the reader 90 can determine if a configuration card is expired.

The configuration card 202 may be securely encrypted with a diversified key based upon information from the access card 204 so that the two cards are tied together. Thus, when the access card 204 expires, the configuration card 202 also effectively expires. Additionally, configuration card 202 can be used only on the access control 16 that the access card 204 is authorized to open. Finally, when finished, if the two cards are separated or one of the cards is reprogrammed or destroyed, then the configuration card 202 becomes unusable and thus the information contained on it is secure.

Figure 5:
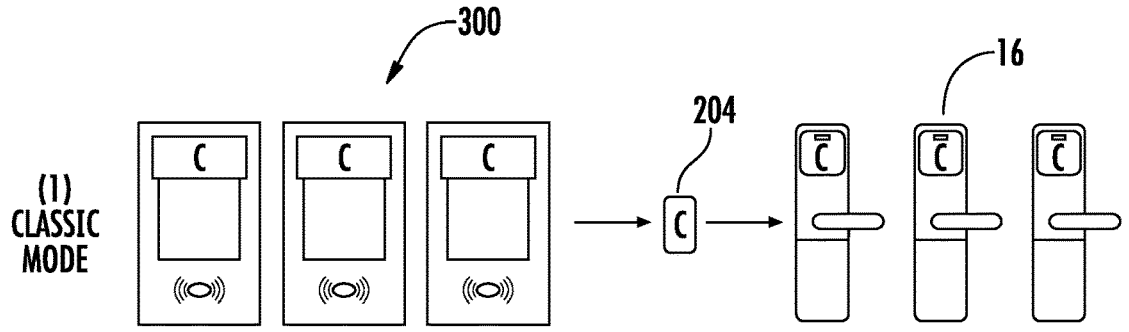
FIG. 5 is a block diagram of a classic mode access control system.

With reference to FIG. 5, an encoder 300 can write to door access cards 204 and the access control 16 can read the cards to determine if guests, housekeepers, or other staff can gain access. Here, access control 16 is in 'classic' mode in which the readers 90 thereof are backwards-compatible in operation with older, less secure cards and technologies such as MIFARE Classic, for example. In this mode the encoder (HT22p) will only encode MIFARE Classic cards with room card data to be door access cards 204. The access control 16 in classic mode will only read MIFARE Classic cards and process the room card data. In this mode, if a high security card is presented to the lock, the reading will fail with feedback 95 such as a red light or with a buzzer sound that indicates failure of the operation. This mode is offered for compatibility to existing installations and legacy systems.

Figure 6:
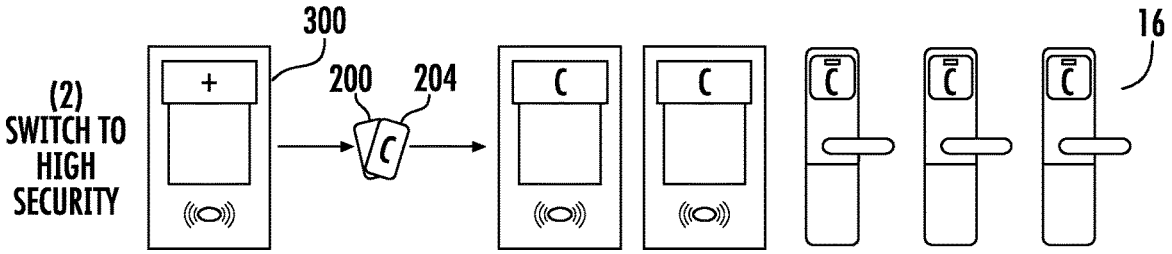
FIG. 6 is a block diagram of an access control system via dual cards.

With reference to FIGS. 6 and 7, when a system is desired to upgrade to high security mode, the dual card encoding method 400 may be performed as follows:

The encoder is prepared to encode (write) an access card (step 402). The user may select a menu option on the encoder or via controlling PMS (Property Management System) software, Font Desk Software 28, etc. The method of instructing the encoder to encode a card is well known.

The user then presents two cards (step 404). For example, one card can be a lower security card, one can be a higher security card: e.g., a MIFARE Classic card and a MIFARE Plus card together simultaneously. Alternatively, first a MIFARE Classic card and immediately thereafter present a MIFARE Plus card subsequently within a short time. Alternatively, if two lower security cards are presented together or in sequence—encode the first as a door access card 204 but reject the second and not encode a configuration card. Alternatively, if two higher security cards are presented together or in sequence—encode the first as a high-security door access card 204 and encode the second as a configuration card 202 to be used to re-configure and roll or change the encryption keys in access control 16 that are already in high-security mode. Alternatively, if no high-security encryption keys are present in the encoder, randomly generate new high-security encryption keys when two cards are presented to the encoder.

Next, encode the first card as the door access card 204 (step 406). If one card is low security and one is high security, the low security card should be encoded as the door access card 204. This provides so that an access control 16 in low security mode can read this access card and then switch to the higher security mode using the method 200 (FIG. 3).

Next, encode the second (higher security) card as the configuration card 202 (step 408). The encoded data contains configuration information to change the access control 16 from low security mode to high security mode, including, but not limited to, the high-security encryption keys. The configuration data is encrypted with a process using information from the first door access card 204, including but not limited to, a unique card ID, payload data from the access card, etc., so that the two cards are tied together and must be used together. A different door access card 204 would have a different unique card ID or different payload data and thus that different access card could not be used in conjunction with this configuration card 202.

Figure 9:
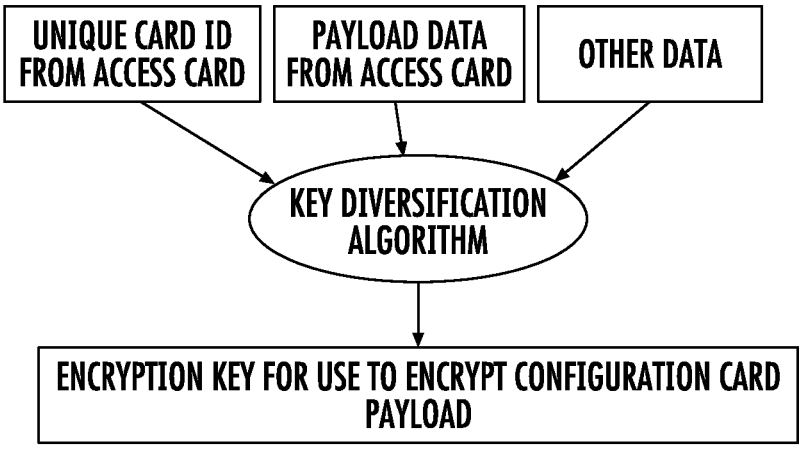
FIG. 9 is a block diagram for generating a diversified encryption key which is used to encrypt the contents of the configuration card.

Alternatively, with reference to FIG. 9, information from the door access card 204 is used to create a diversified encryption key by a hash or encryption process that incorporates multiple information inputs and produces an encryption key that is related to all of the inputs (FIG. 7, step 410). These key diversification algorithms are well known in the art of cryptography, for example NXP has published an application note for key diversification (http://www.nxp-.com/documents/application_note/AN10922.pdf). This diversified encryption key is then used to encrypt the contents of the configuration card 202.

The user then presents the two cards together to another device that can read the cards and the device reads the cards in sequence or together (step 420). This step may be the same as method 200 described in FIG. 3 where the device is an access control 16. Both cards are identified and read to determine the type of card and information contained on the card (e.g. whether this is a door access card 204 a configuration card 202 or both and which is which).

For a door lock type device 16, the access card is processed first. If the access card is valid: a) Authorized for this device, and b) Not expired, then the lock will process the configuration card by decrypting the payload based on information from the access card and then use the configuration data to switch to a high security mode of operation with the specified encryption keys.

Figure 8:
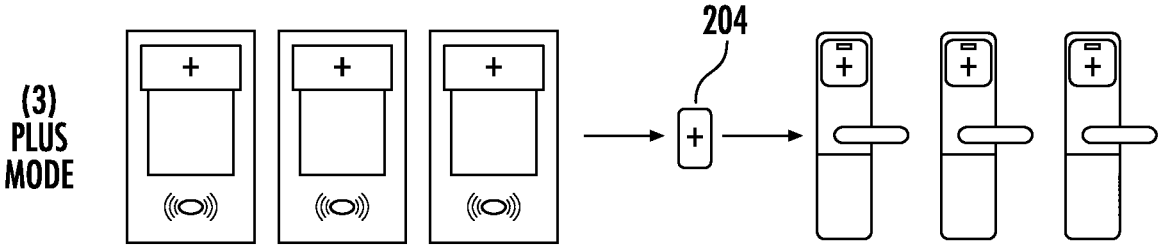
FIG. 8 is a block diagram of an access control system in a plus mode.

Alternatively, if the device in step 420 is another encoder 300 that is instructed to read a card, it will detect the two cards in the field and after reading them, will retrieve the encryption keys from the configuration data on the configuration card and save the encryption keys for later use in encoding high-security door access cards 204 and (optionally) switch to a high security mode. Alternatively, the encoder can use a 'mode' where it would not program a high-security card until it was configured to be in high-security mode (FIG. 8).

If the device in step 420 is an access control 16 and is a door lock (e.g. for a hotel room door) then it will enter a high-security mode after processing the configuration card. This means the door lock would no longer accept low-security cards. So, if after switching modes, the same low-security door access card was presented to the lock, it would no longer be read but would be rejected with e.g. a red light.

If the access control 16 was already in high-security mode and the two cards presented were both high-security cards, the card with access data would be processed first and then the configuration card would be processed. In this case, the lock is already in high-security mode and so would not change modes. The configuration data could change some other operating parameter in the access control 16. For example, the configuration data could include new high-security encryption keys and the lock would roll or change its encryption keys to these new ones. The rolling or changing of encryption keys could happen immediately. Optionally, to minimize disruption to an actively used access control system, the new encryption keys could be stored in the access control 16 and access cards 204 could be encoded using the old keys (if an encoder was not upgraded yet) or new keys (if it was upgraded) and the access control 16 could use either old or new keys for some amount of time until the old keys would expire. Or, optionally, the encoder would provide an indication in the access card 204 that the old keys should no longer be used and the lock would then delete the old keys. Or, optionally, the lock only stores the new keys and the encoder would put both access rights encoded using the old keys and access rights encoded using the new keys on the access card 204. In this case, locks that had not yet rolled to new keys would use the access rights encoded with old keys and locks that had rolled would use the access rights encoded with new keys. The encoder could then only put access rights encoded using the new keys on cards after all the locks had been rolled.

On a successful configuration step, the device (lock 16 or encoder 300) could indicate feedback to the user via Audio, or LED light sequence, etc. that the operation was completed (step 430). In one example, a distinctive indication may be utilized so that the user can differentiate normal operations from a successful (or failed) configuration operation.

An alternate embodiment of the method is where the encoder 300 has a menu option to encode a configuration card or the front desk software 28 that controls the encoder has a menu option. The encoder would 1) cache the previously encoded access card 204 or 2) could read an access card 204 and then follow steps 408-410 above to create the associated configuration card. Or, another option is to 3) provide menu options to re-encode a specified access card and then would follow all steps 402-410 above in sequence with both cards. One benefit of this alternate embodiment is so that the creation of configuration cards could be controlled based on user permissions in the encoder 300 or front desk software 28.

Another alternate embodiment is where the encoder 300 is a software application running locally at the hotel or in the cloud and communicating with an encoding device that can encode physical cards. This would apply to either the case where the application and encoder are performing steps 402-408, or encoding access cards 204, or configuration cards 202. Or this could apply to the case in step 420, for example, where an older system is being upgraded to a new software based system that needs to retrieve the old keys from the old encoders. By reading the access card and configuration card encoded by old encoders, the new software-based system is operable to securely receive the keys and can then participate in the hotel system without requiring a new encryption key to be programmed into all the access controls 16.

With reference to FIG. 8, the system is now operating in Plus Mode or High Security mode. The encoder will encode MIFARE Classic OR MIFARE Plus cards, but doors will only accept MIFARE Plus cards.

Figure 10:
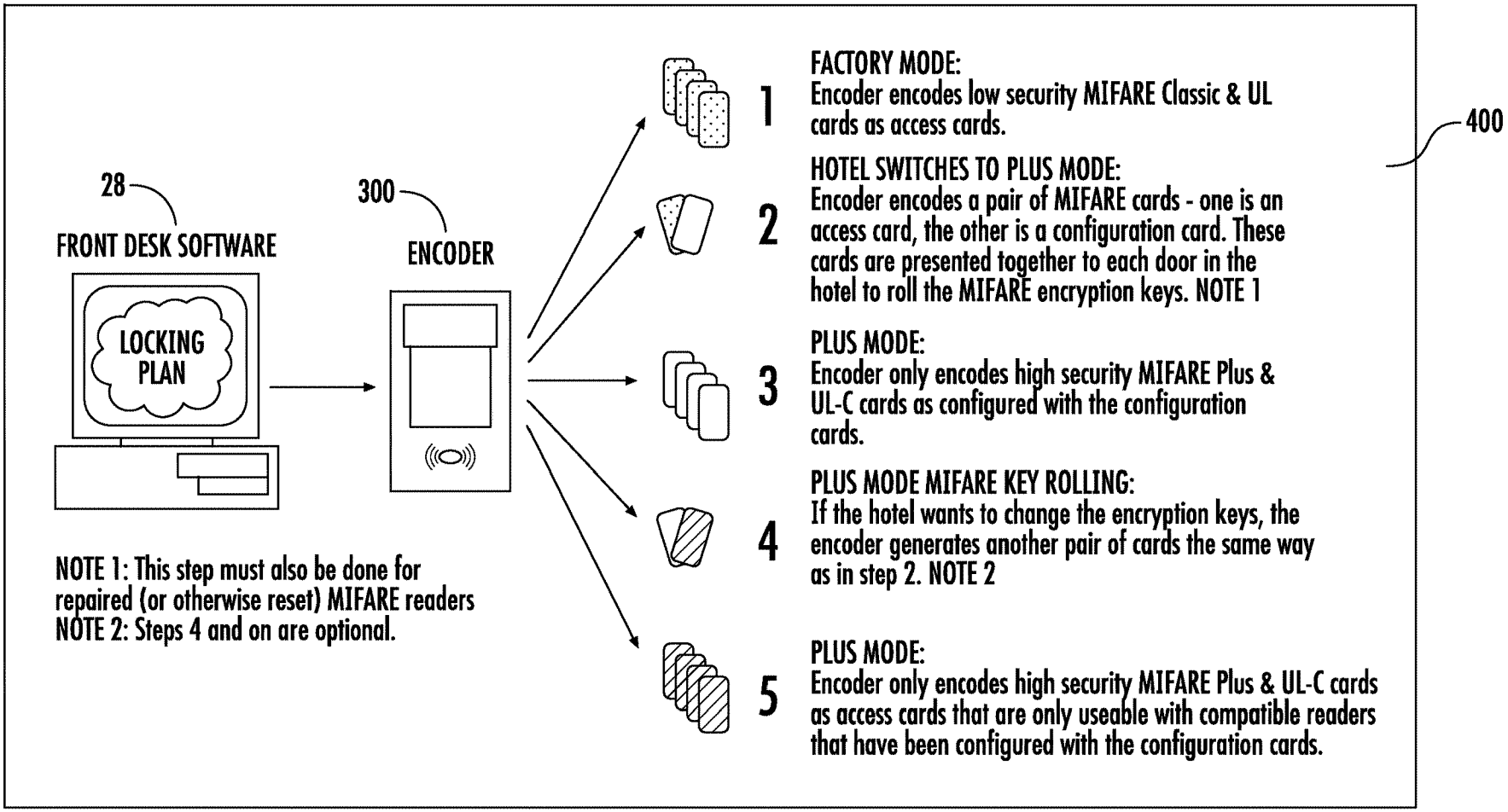
FIG. 10 is a block diagram encoder embodiment perspective.

With reference to FIG. 10, an encoder perspective of the method described above begins with 1) a Factory mode where it is compatible with 'classic' devices and cards. Then, after 2) using the method 400 above, it switches to 3) a Plus mode where it only encodes high security cards (unless the configuration method 400 above is used again and in that case it creates a classic access card for the sole purpose of upgrading a lock that is still in factory mode, for example a replacement lock from the factory for another lock that failed). Then, the method 400 above can be used again to 4) Roll keys in the property so that it can still operate in a 5) Plus mode with new keys.

Figure 11:
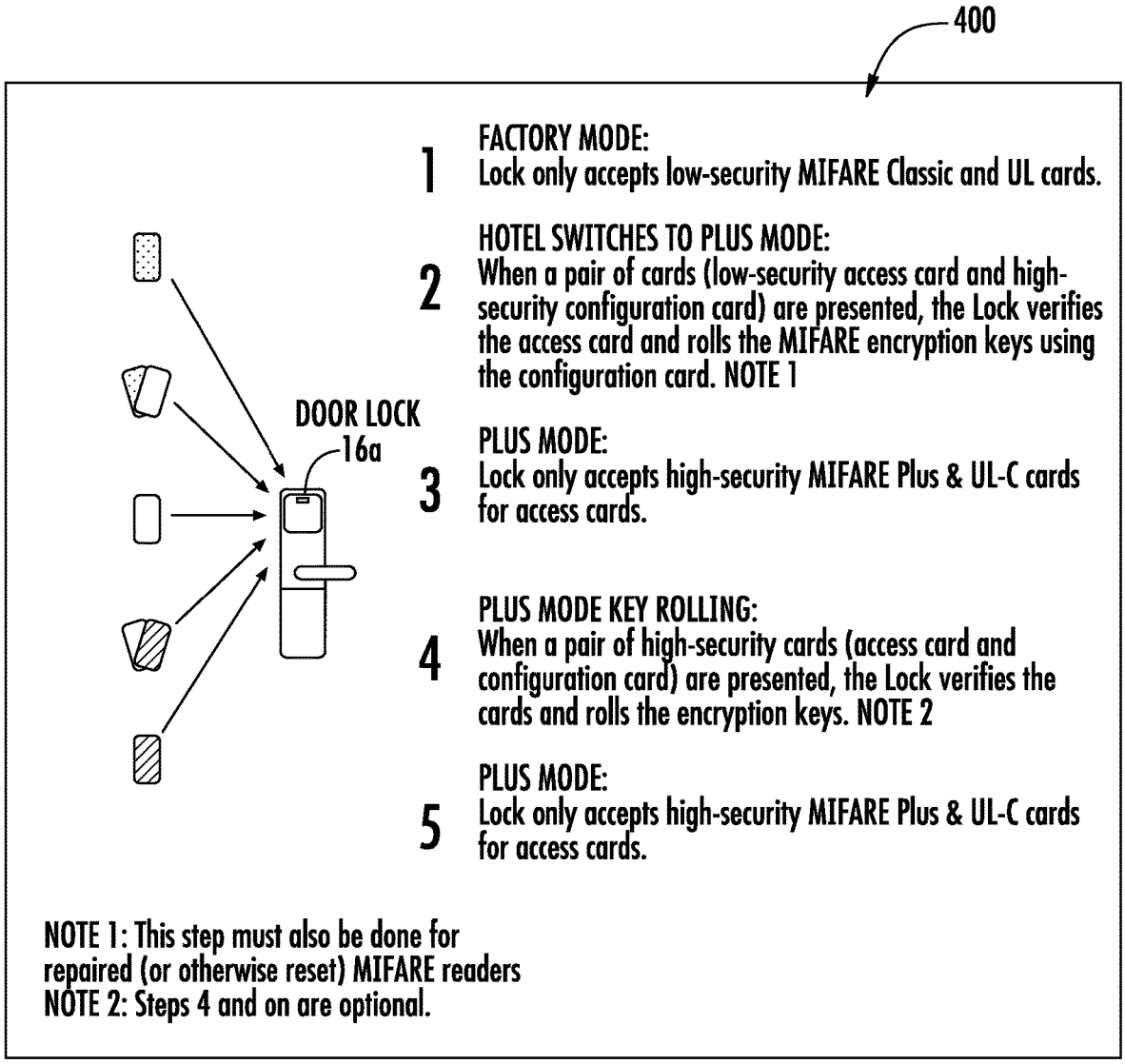
FIG. 11 is a block diagram lock embodiment perspective.

With reference to FIG. 11, a lock perspective of the method described above begins with 1) Factory mode where the lock only reads low security cards but can be switched to a high security mode using 2) The methods 200 and 400 above. In 3) Plus mode, the lock then would reject a classic/low-security card and only read high-security cards. But, it could also read a high-security access card and configuration card to 4) Roll the keys to a different set of high-security keys and then 5) Operate in a high security mode with new keys.

Another embodiment is to utilize a mobile device 12 (FIG. 1) as either the access card or configuration card or both. When used as one of the cards, the mobile device 12 would be presented to the encoder 300 (FIGS. 5, 6, 8) along with another card. The encoder 300 writes using the standard RFID protocols to the card or to the mobile device. The mobile device 12 would emulate a card to the encoder and the encoder would not know that the mobile device 12 is not a card. Then, the mobile device 12 could be presented with the card to the lock to complete the two card presentation. Again, the lock would not know that the mobile device 12 is not a card. In the case when the mobile device 12 is both cards, it would present itself as first one card and then as a second card, presenting two different card types and UIDs to the encoder 300. The mobile device 12 would use the sequence embodiment of the method where the cards are presented in rapid sequence. The mobile device 12 would then present both cards in sequence to the access device 16 to affect the method of programming.

Optionally, the card data on the mobile device 12 could be over the air downloaded from a remote service and the mobile device could present the card data as two cards to the encoder 300 to change the encoder into a high security mode and then be presented as two cards to a lock 16*a* to change the lock into a high security mode.

Optionally, the mobile device 12 could be encoded with an access card by an encoder with the mobile device 12 in card emulation (this is part of the NFC standard), and then the mobile device 12 could utilize the access card along with over the air downloaded information to create a configuration card on the mobile device that could be presented as the second card. Optionally, the access card data could be uploaded to a service that then creates the configuration card based on the access card and downloads the configuration card to the mobile device so that the encryption keys and process of creating the configuration card is done by a secure service and not exposed on the mobile device. The mobile device 12 could then present the two cards together in sequence as emulated cards to be read by an encoder 300 or access device 16.

Yet another additional embodiment is where the encoder 300 and the mobile device 12 are combined into a single device. An administrator would program the access device 16 using the mobile device 12 which would simulate an access card 204 and a configuration card 202 using card emulation mode (again, part of NFC) when presented to the access device 16.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method of programming an access control system, the method comprising:

presenting an access card and a configuration card to a radio-frequency identification (RFID) field of an access control device, the configuration card encrypted with a diversified key based upon information from the access card such that when encrypted data stored within the access card expires, the encrypted diversified key within the configuration card expires and the configuration card is unusable for configuring the access control device, the configuration card usable only on a single access control that the access card is authorized to open;

determining a validity of the access card at the access control device;

processing the configuration card at the access control device in response to the validity of the access card;

decrypting a payload on the configuration card based on information from the access card; and using the payload from the configuration card to configure the access control device to a high security mode of operation such that the access control device thereafter only accepts high-security access cards in the high security mode of operation.

2. The method as recited in claim 1, further comprising using encryption keys from the payload on the configuration card for use with a door lock.

3. The method as recited in claim 1, further comprising using encryption keys from the payload on the configuration card for use with an encoder.

4. The method as recited in claim 1, wherein presenting the access card and the configuration card includes presenting the access card and the configuration card as high security cards.

5. The method as recited in claim 1, wherein presenting the access card and the configuration card includes presenting the access card as a low security card and the configuration card as high security card.

6. The method as recited in claim 1, wherein presenting the access card and the configuration card includes presenting at least one of the access card and the configuration card via a mobile device.

7. The method as recited in claim 1, wherein presenting the access card and the configuration card includes presenting the access card and the configuration card via a mobile device.

8. The method as recited in claim 1, wherein switching the device to a high security mode of operation is a software based front desk system that is upgrading an old system and keys are being transferred from the old system to a new software system.

9. The method as recited in claim 1, wherein processing the configuration card at the device in response to the validity of the access card is not processing the configuration card if the access card is expired.

10. The method as recited in claim 1, wherein the access control device reads the access card and the configuration card in sequence.

11. The method as recited in claim 1, wherein the access control device reads the access card and the configuration card together.

12. A method of programming an access control system, the method comprising:

encoding a first card as an access card and a second card as a configuration card;

presenting the access card and the configuration card to a radio-frequency identification (RFID) field of an access control device, the configuration card encrypted with a diversified key based upon information from the access card such that when encrypted data stored within the access card expires, the encrypted diversified key within the configuration card expires and the configuration card is unusable for configuring the access control device, the configuration card usable only on a single access control that the access card is authorized to open;

determining a validity of the access card at the access control device;

processing the configuration card at the access control device in response to the validity of the access card;

decrypting a payload on the configuration card based on information from the access card, wherein information from the access card is used to create a diversified encryption key by an encryption process that incorporates multiple information inputs and produces an encryption key that is related to all of the multiple information inputs which is then used to encrypt contents of the configuration card; and using the payload from the configuration card to configure the access control device to a high security mode of operation and change an encryption key in the single access control such that the single access control only accepts high-security access cards in the high security mode of operation.

13. The method as recited in claim 12, further comprising using encryption keys from the payload on the configuration card for use with an access control device.

14. The method as recited in claim 12, further comprising using encryption keys from the payload on the configuration card for use with the access control device that is a door lock.

15. The method as recited in claim 12, further comprising using encryption keys from the payload on the configuration card for use with the access control device that is an encoder.

16. The method as recited in claim 12, wherein presenting the access card and the configuration card includes presenting the access card and the configuration card as high security cards.

17. The method as recited in claim 12, wherein presenting the access card and the configuration card includes presenting the access card as a low security card and the configuration card as high security card.

18. The method as recited in claim 12, wherein presenting the access card and the configuration card includes presenting at least one of the access card and the configuration card via a mobile device.

19. The method as recited in claim 12, wherein presenting the access card and the configuration card includes presenting the access card and the configuration card via a mobile device.

20. The method as recited in claim 12, further comprising providing an indication of completion in response to the switch of the device to the high security mode of operation.

21. The method as recited in claim 12, further comprising presenting the access card and the configuration card simultaneously.

22. The method as recited in claim 12, wherein processing the configuration card at the device in response to the validity of the access card is not processing the configuration card if the access card is expired.

* * * * *